US005394905A

United States Patent [19]

Griffith

[11] Patent Number: 5,394,905

[45] Date of Patent: Mar. 7, 1995

[54] LENO HEALD SUBASSEMBLY FOR COOPERATION WITH A MAIN HARNESS FRAME

[75] Inventor: John D. Griffith, Sunderland, England

[73] Assignee: Griffith Textile Machines Limited, Tyne & Wear, England

[21] Appl. No.: 945,008

[22] Filed: Sep. 15, 1992

[30] Foreign Application Priority Data

Sep. 23, 1991 [GB] United Kingdom ..... 9120272

[51] Int. Cl.[6] ..... D03C 7/06

[52] U.S. Cl. ..... 139/50; 139/57; 139/91; 139/93

[58] Field of Search ..... 139/50, 51, 52, 53, 139/54, 48, 49, 57, 58, 95, 91, 92, 93

[56] References Cited

U.S. PATENT DOCUMENTS 1,435,615 11/1922 Moreau ..... 139/50
1,470,862 10/1923 Minville ..... 139/50
3,131,728 5/1964 Juillard ..... 139/50 X
3,952,778 4/1976 Volpe ..... 139/54

FOREIGN PATENT DOCUMENTS 2227618 1/1974 Germany .
579162 8/1976 Switzerland .
808084 1/1959 United Kingdom .
829751 3/1960 United Kingdom .

*Primary Examiner*—Andrew M. Falik
*Attorney, Agent, or Firm*—Dann, Dorfman, Herrell and Skillman

[57] ABSTRACT

A heald assembly for leno weaving, the assembly including first and second heald frames each of which is adapted for slidable reception in heald guides of a weaving loom, at least one of the heald frames including a main frame and a sub-frame carrying a plurality of dents spaced in the weft direction of the one heald frame, the sub-frame being co-planar with the main frame and being movably mounted on the main frame for reciprocal movement in the weft direction.

10 Claims, 2 Drawing Sheets

LENO HEALD SUBASSEMBLY FOR COOPERATION WITH A MAIN HARNESS FRAME

FIELD OF THE INVENTION

The present invention relates to a heald assembly for leno weaving.

BACKGROUND OF THE INVENTION

The invention is directed to apparatus for leno weaving, of the type used for making burlap or gauze fabrics. Traditionally leno weaving was achieved by threading a specially-manufactured leno loom with the warps arranged in crossed pairs. By manipulating one of the warps of each pair relative to the other, the crossing was positioned either in advance of the shed opening or behind the shed opening alternately in successive sheds, resulting in the warps crossing and uncrossing one another on successive picks, and producing a leno weave.

British patent No. 808,084 discloses improvements in a leno loom which embodies two heald frames which are moved transversely (in the weft direction) relative to one another during the shedding operations to achieve the crossing of the warps as illustrated in FIGS. 1 and 2 of the patent.

Leno weaving has also been used to form selvages in shuttleless looms, as shown in U.S. Pat. Nos. 3,131,728 and 3,952,778. In such cases, the mechanism needs to control only the warp pairs which comprise the selvage.

It is a general aim of the present invention to provide a heald assembly which enables easy conversion of a standard loom for leno weaving.

SUMMARY OF THE INVENTION

According to one aspect of the present invention there is provided a heald assembly for leno weaving, the assembly including first and second heald frames each of which is adapted for slidable reception in heald guides of a weaving loom, at least one of the heald frames including a sub-frame carrying dents, the sub-frame being movably mounted on said one frame for reciprocal movement in the weft direction.

In a normal loom each heald is raised and lowered by a respective group of lifting rods spaced apart in the weft direction; adjacent groups being spaced in the warp direction. In accordance with the present invention the heald frames are adapted for detachable connection to respective groups of lifting rods. Preferably the sub-frame is slidingly mounted on the heald frame and a lever assembly is provided for causing reciprocation of the sub-frame, the lever assembly being adapted for connection to a lifting rod in a group adjacent to the group causing raising and lowering of said heald frame. Preferably the lever assembly comprises a bell-crank lever pivotally mounted on the heald frame with one end connected to the sub-frame and the other end adapted for connection to said lifting rod.

According to another aspect of the present invention there is provided a heald frame assembly including a main frame adapted for slidable mounting in a loom and a sub-frame carrying dents, the sub-frame being hingeably connected to the main frame via a hinge axis extending in the weft direction, the sub-frame being movable about said axis between a normal weaving position whereat it is co-planar with the main frame and a threading position whereat it resides at an angle to the main frame.

According to another aspect of the present invention there is provided a heald frame including an upper frame member and a lower frame member, a plurality of long dents mounted between the upper and lower frame members and a plurality of short dents mounted on one frame member only, each short dent being located between an adjacent pair of long dents, each short dent being of strip like form and having a twisted head portion containing a heald eye. Preferably the head portion has a tapered terminal end.

BRIEF DESCRIPTION OF THE DRAWINGS

Various aspects of the present invention are hereinafter described with reference to the accompanying drawings, in which.

DESCRIPTION OF THE PREFERRED EMBODIMENT

The leno heald assembly 10 according to the present invention is arranged to produce leno weaving in a similar manner to that described in UK patent 808084 wherein a pair of head frames are located side by side and oscillated relative to one another in the weft direction to create a leno weave.

Figure 1:
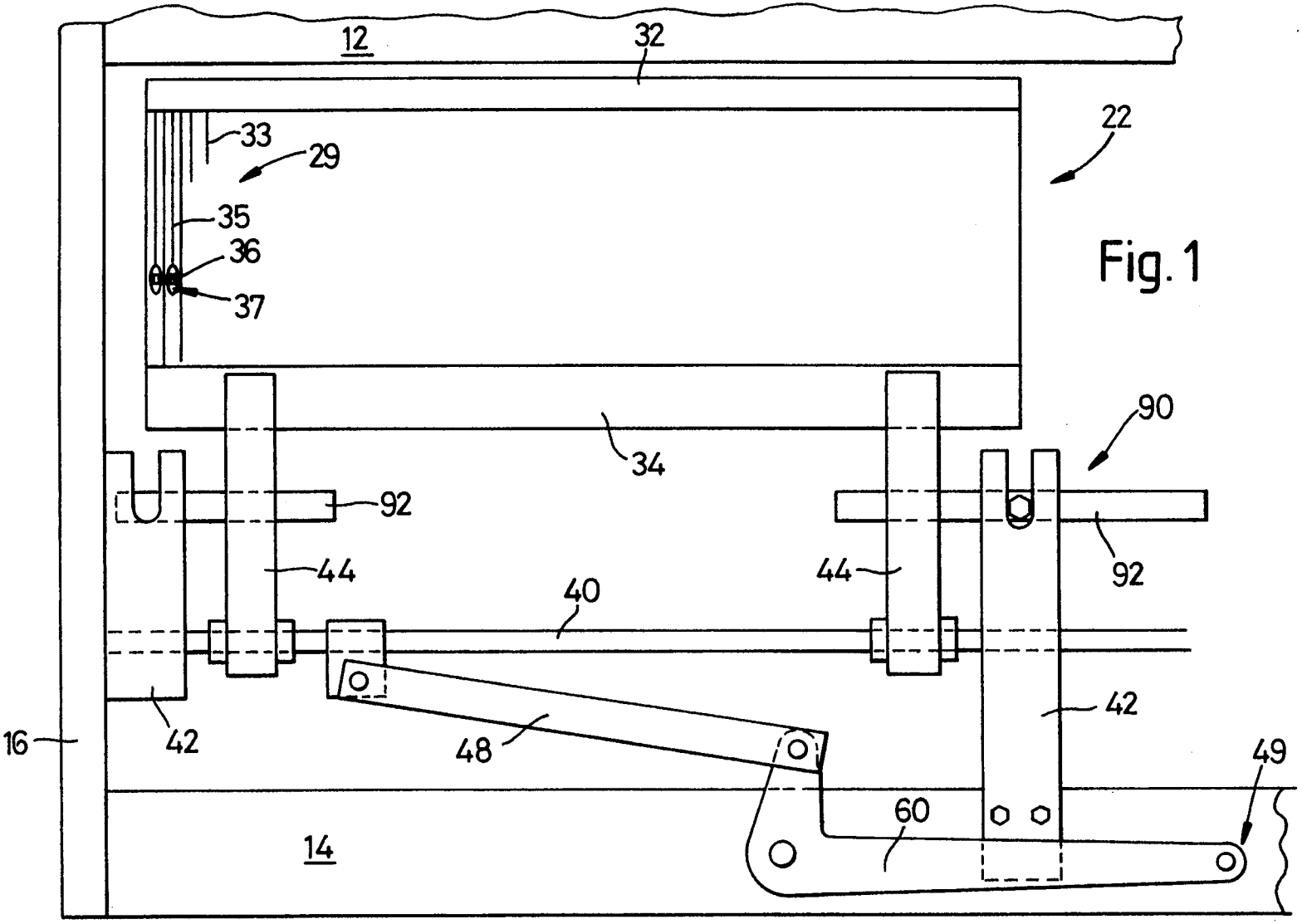
FIG. 1 is a front view of part of a heald frame according to the present invention.

In accordance with the present invention a pair of side by side heald frames 30,31 are provided and each heald frame has an upper and lower frame members 12,14 interconnected at opposite ends by end frame menders 16 (only one of which is shown in FIG. 1).

The frame members 16 are slidingly received in heald frame guides of a standard loom (not shown) for guiding and raising and lowering position of the heald frames. Accordingly, both heald frames of the leno heald assembly of the present invention can be fitted into a standard loom, for example a Sulzer Projectile Loom (e.g. of 153 inches width), without modification of the loom.

In order to provide relative movement between the frames in the weft direction for leno weaving the frame 30 includes a main frame defined by said frame members 12,14 and 16 and a plurality of sub frames 22 (only one of which is fully shown in FIG. 1 on which the dents 29 are mounted). Separate sub-frames 22 are located side by side in the weft direction to provide dents across the entire length of the heald frame 30.

Each sub-frame is provided with upper and lower frame elements 32,34 between which relatively long dents 33 extend. Inbetween each pair of dents 33, a relatively short dent 35 is located which has a heald eye 36 at its head portion 37 through which a warp yarn passes. A yarn 39 passing through a heald eye in one frame passes between adjacent dents 33 in the neighboring frame 24.

A support bar 40 extends along the heald frame 30 and is slidably supported in posts 42 projecting from the frame member 14. Each sub-frame 22 includes a pair of support legs 44 which depend from the lower frame element 34 and which are mounted on the bar 40 for axial movement therewith.

A bell-crank lever 60 is pivotally mounted on the lower frame member 14 and is connected at one end to the bar 40 via a linkage 48. Accordingly on raising and lowering of the opposite end 49 of the lever 60 the bar, 40 is caused to reciprocate in the weft direction and in so doing reciprocates at the sub frames connected thereto.

Figure 2:
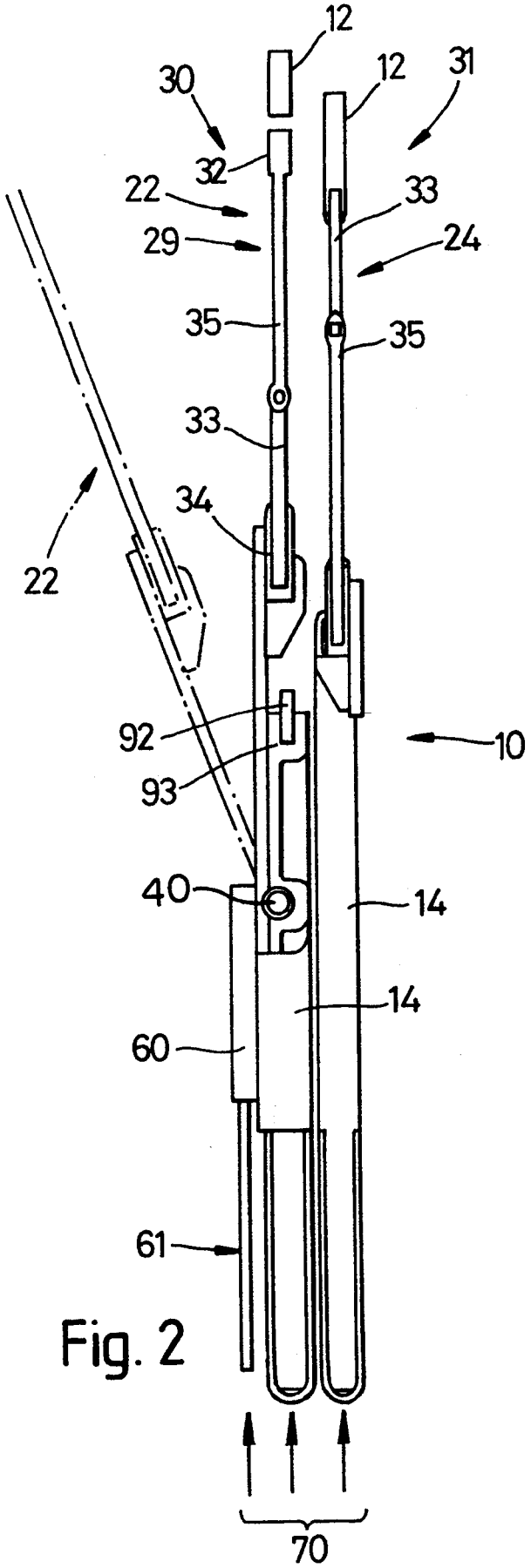
FIG. 2 is a side view of a leno heald assembly according to the illustrated embodiment of the present invention.

As illustrated schematically in FIG. 2, the heald frames are raised and lowered by respective groups of lifting rods 70 of the loom. For this to be achieved, the lower frame member 14 is adapted in a conventional manner, for detachable connection to their respective lifting rods. A conventional detachable connection is illustrated in Swill Patent No. 579,162.

In order to cause raising and lowering of the end 49 of lever 60, a link 61 is provided which is connected at one end to lever 60 and is detachably connected at its other end to one of the lifting rods of the group adjacent to the group causing lifting of the heald frame 30. In this way the conventional lifting rods of the loom can be used for causing reciprocation of the sub-frames 22. In view of the small number of moving parts and since no modifications are necessary to the loom for drawing of the heald frames the loom is able to weave at relatively high speeds.

In order to assist threading of the warp yarns through the heald frames, the sub frames are preferably hingedly connected to the main frame. This is conveniently achieved by the legs 44 being rotatably received on the bar 40.

The sub frames 22 are held in a normal weaving position, whereat they are co-planar with the main frame, by a releasable catch 90 mounted on post 42 which is co-operable with an adjacent leg 44. Each catch 90 is preferably defined by a bar 92 which normally resides in a channelled seat 93 (FIG. 2) formed on the adjacent leg 44.

The bar 90 is biased into contact with the seat 93 and on being raised enables the sub-frame to hinge on bar 40 to reside at an inclined position (indicated in broken lines in FIG. 2). At the inclined position, threading can be easily achieved since access to both sides of the dents of both heald frames is possible.

Figure 3:
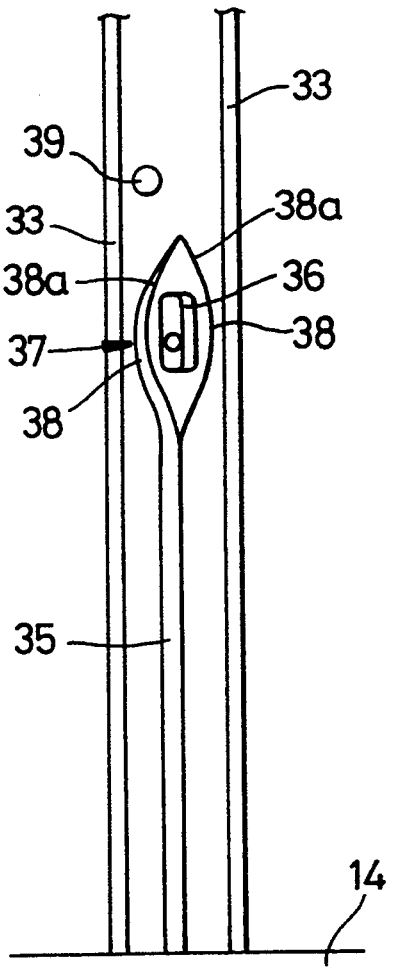
FIG. 3 is a more detailed view of a dent arrangement according to the present invention.

Preferably as indicated more clearly in FIG. 3, the relatively short dents 35 are of strip like form and the head portion 37 .in which the heald eye 36 is located, is twisted. This has the effect providing the head portion 37 with a greater width dimension in the weft direction so that the side edges 38 of the head portion are aligned in the warp direction and lie adjacent to the neighboring dents 33. Accordingly side edges 38 can abut successive dents 33 on each side during leno weaving and receive support therefrom. This enables the strip from which the dents are formed to be relatively thin and thereby enable relatively small dent spacings to be achieved, for example in the region of 2mm.

Since the heald eye 36 is formed in the side face of the strip, the eye 36 can be relatively large and is not affected by reducing the dent spacing.

In order to facilitate passage of the non captive warp yarn 39 between the short dent 35 and the adjacent longer dents 30 the terminal end of the head portion 37 preferably has tapered sides 38*a*.

I claim:

1. A heald assembly for leno weaving, for use in a weaving loom having heald guides, the assembly including first and second heald frames extending in a weft direction, each of which is adapted for vertical slidable reception in the heald guides of the weaving loom, and a plurality of groups of heald frame lifting rods for raising and lowering a plurality of heald frames in the heald guides, the rods in each group being spaced in the weft direction and the groups being spaced in a warp direction, wherein said first and second heald frames are adapted for detachable connection to respective groups of lifting rods, at least one of the heald frames including a main frame and a sub-frame carrying a plurality of dents spaced in the weft direction, the sub-frame in a normal weaving position being co-planar with the main frame, means in the main frame slidably mounting said sub-frame on said main frame for reciprocal movement in the weft direction and a lever assembly for causing said reciprocal movement of the sub-frame, the lever assembly being adapted for connection to a lifting rod in a group of rods adjacent to the group causing raising and lowering of said one heald frame.

2. A heald assembly according to claim 1, wherein the lever assembly comprises a bell-crank lever pivotally mounted on said main frame of said one heald frame with one end connected to the sub-frame and the other end adapted for connection to said lifting rod.

3. A heald assembly according to claim 1, wherein the main frame hingedly supports the sub-frame via a hinge axis extending in the weft direction, the sub-frame being movable about said axis between said normal weaving position co-planar with the main frame and a threading position at an angle to the main frame.

4. A heald assembly according to claim 1, wherein the sub-frame includes an upper frame member and a lower frame member and a plurality of long dents mounted between the upper and lower frame members and a plurality of short dents mounted on one of said frame members only, each short dent being located between an adjacent pair of long dents, each short dent being of strip-like form and having a twisted head portion containing a heald eye.

5. A heald assembly according to claim 4, wherein the head portion of each short dent has a tapered terminal end.

6. A heald frame assembly for use in a weaving loom including a main frame extending in a weft direction and adapted for slidable mounting in the loom and a sub-frame carrying dents, said main frame hingedly supporting the sub-frame via a support bar having a hinge axis extending in the weft direction, the sub-frame being mounted on said support bar for movement about said axis between a normal weaving position whereat it is co-planar with the main frame and a threading position whereat it resides at an angle to the main frame.

7. A heald frame including an upper frame member and a lower frame member, a plurality of long dents mounted between the upper and lower frame members and a plurality of short dents mounted on one frame member only, each short dent being located between an adjacent pair of long dents, each short dent being of strip like form having opposed side edges aligned in a warp direction and having a twisted head portion which in a weft direction has a greater width than the remainder of the short dent, the head portion containing a heald eye passing therethrough.

8. A weaving loom including a main frame extending in a weft direction slidably mounted in the loom and a sub-frame carrying dents, the main frame having a support bar hingedly supporting the sub-frame via a hinge axis extending in the weft direction, the sub-frame being movable about said axis between a normal weaving position whereat it is mounted by said support bar at a weaving position co-planar with the main frame and at a threading position whereat it resides at an angle to the main frame.

9. A loom including a heald frame having an upper frame member and a lower frame member, a plurality of long dents mounted between the upper and lower frame members and a plurality of short dents mounted on one frame member only, each short dent being of strip like form having opposed edges aligned in a warp direction and having a twisted head portion which in a weft direction has a greater width than the remainder of the short dent, the head portion containing a heald eye passing through.

10. A leno weaving loom having heald guides including a heald assembly comprising first and second heald frames extending in a weft direction, each of which is slidably mounted in said heald guides, heald frame lifting rods for raising and lowering the heald frames in the heald guides, at least one of the heald frames including a sub-frame carrying a plurality of dents spaced in the weft direction, the sub-frame in a normal weaving position being co-planar with the main frame and means mounting said sub-frame on said main frame for reciprocal movement in the weft direction and a lever assembly for causing said reciprocal movement of the sub-frame, the lever assembly being adapted for connection to a heald frame lifting rod causing raising and lowering of said one heald frame.

* * * * *

UNITED STATES PATENT AND TRADEMARK OFFICE

CERTIFICATE OF CORRECTION

PATENT NO. : 5,394,905

DATED : March 7, 1995

INVENTOR : John D. Griffith

It is certified that errors appear in the above-identified patent and that said Letters Patent is hereby corrected as shown below:

Column 3, Line 14, "Swill" should be --Swiss--.

Signed and Sealed this

Twenty-fifth Day of April, 1995

*Attest:*

*Attesting Officer*

BRUCE LEHMAN

*Commissioner of Patents and Trademarks*